US006093043A

United States Patent [19]

Gray et al.

[11] Patent Number: 6,093,043

[45] Date of Patent: Jul. 25, 2000

[54] CONNECTOR LOCKING MECHANISM

[75] Inventors: Ian James Stafford Gray, Nr Winchester; John Edward Simpson, Portsmouth, both of United Kingdom

[73] Assignee: ITT Manufacturing Enterprises, Inc., Wilmington, Del.

[21] Appl. No.: 09/049,160

[22] Filed: Mar. 26, 1998

[30] Foreign Application Priority Data

Apr. 1, 1997 [GB] United Kingdom ..... 9706540

[51] Int. Cl.[7] ..... H01R 13/627

[52] U.S. Cl. ..... 439/352

[58] Field of Search ..... 439/350, 352

[56] References Cited

U.S. PATENT DOCUMENTS

| | | | |
|---|---|---|---|
| 4,915,642 | 4/1990 | Lin et al. | 439/352 |
| 5,176,533 | 1/1993 | Sakurai et al. | 439/352 |
| 5,211,572 | 5/1993 | Comstock et al. | 439/352 |
| 5,445,534 | 8/1995 | Ishizuka et al. | 439/352 |
| 5,807,129 | 9/1998 | Konda et al. | 439/348 |

FOREIGN PATENT DOCUMENTS

| | | |
|---|---|---|
| 0 105 810 A2 | 9/1983 | European Pat. Off. . |
| 0 227 288 A2 | 11/1986 | European Pat. Off. . |
| 2 300 768 | 5/1996 | United Kingdom . |

*Primary Examiner*—Gary F. Paumen
*Assistant Examiner*—Truc Nguyen
*Attorney, Agent, or Firm*—Thomas L. Peterson

[57] ABSTRACT

A connector (1) including a contact (3) for connecting to a mating half and a locking element (2), the locking element (2) having a locked position preventing connection or disconnection of the contact (3) with the mating half and an unlocked position preventing connection or disconnection, wherein transition between the locked and unlocked positions is governed by a spring means (5) formed as an integral part of the locking element (2), the spring means (5) being unbiased when the locking element (2) is in the locked position.

2 Claims, 5 Drawing Sheets

CONNECTOR LOCKING MECHANISM

This invention relates to connector having a locking element and more particularly but not solely to a cable connector.

Connectors used to releasably couple a cable to a piece of equipment or two cables together are well known, one such example is a standard coaxial cable connector where a cylindrical cable end connector has a diameter that fits flushly into an appliance end connector that comprises a hollow cylinder with a similar internal shape but a larger diameter. Coupling two such connectors together is performed by sliding the cable end connector into the cavity defined by the larger appliance end piece.

Where accidental disconnection of a connector-connector joint is to be prevented, for example where the connection is in an easily accessible position such as running across an office floor or where disconnection would prove costly or dangerous (data communications, control systems, etc), a form of locking mechanism is needed.

Figure 1:
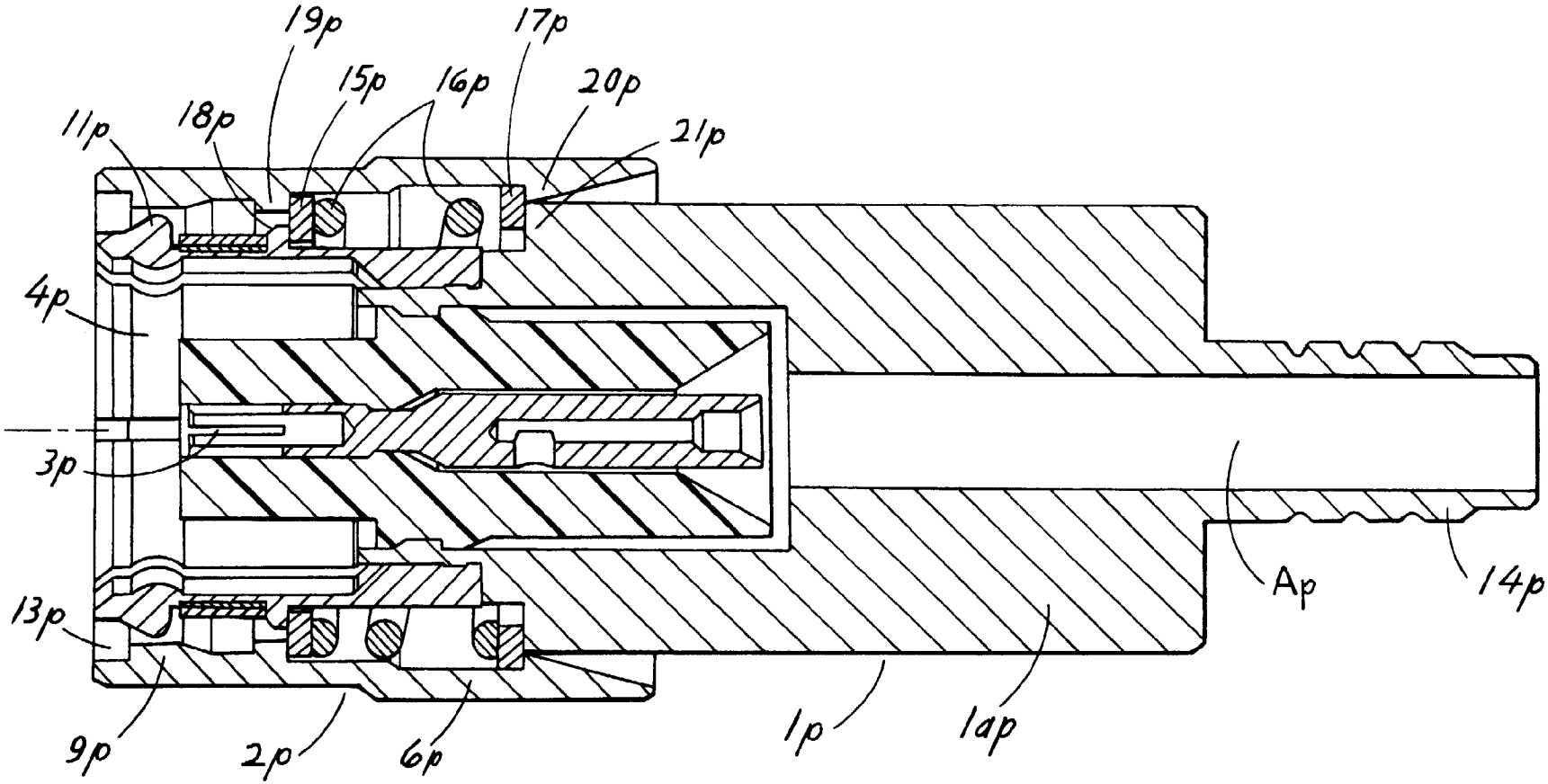
FIG. 1 PRIOR ART

In the prior art, shown in FIG. 1, a coaxial connector (1*p*) includes a locking mechanism (2*p*). The locking mechanism comprises a sleeve (6*p*) fitted around a body (1*ap*) of the connector (1*p*), the sleeve (6*p*) being able to slide along the connection-cable axis (Ap) around the connector (1*p*). Disposed between the sleeve (6*p*) and the body (1*ap*), a coiled spring (16*p*) is held between two washers (15*p*, 17*p*). The washers (15*p*, 17*p*) are retained in place by shoulders (19*p*, 20*p*) positioned on the inner surface of the sleeve (6*p*) and shoulders (18*p*, 21*p*) on the outer surface of the body (1*ap*).

The sliding of the sleeve (6*p*) along the axis Ap is controlled by the spring (16*p*), shoulders (18*p*–21*p*) and washers (15*p*, 17*p*) . If a force is exerted on the sleeve (6*p*) along axis Ap towards a cable end (14*p*) of the body (1*ap*), one or more sleeve shoulders (19*p*) are pressed against the first washer (15*p*) in the direction of the cable end (14*p*) along axis Ap. This force is transferred via the spring (16) to the second washer (17*p*). The second washer (17*p*) is held in place against the force exerted by the spring (16*p*) by connector shoulders (21*p*), thus the spring (16*p*) is compressed along the axis Ap and the sleeve (6*p*) moves along the same axis in the direction of the cable end (14*p*) of the connector (1*p*). When the force exerted on the sleeve (6*p*) is released, the potential energy stored in the spring (16*p*) due to its compression is released, forcing the first washer (15*p*) and therefore the sleeve (6*p*) back to its neutral position. An equal action and reaction occurs if a force is exerted on the sleeve (6*p*) along axis A towards a mating end (13*p*) of the connector (1*p*) due to the symmetrical configuration of the spring (16*p*), washers (15*p*, 17*p*) and shoulders (18*p*–21*p*).

Figure 2:
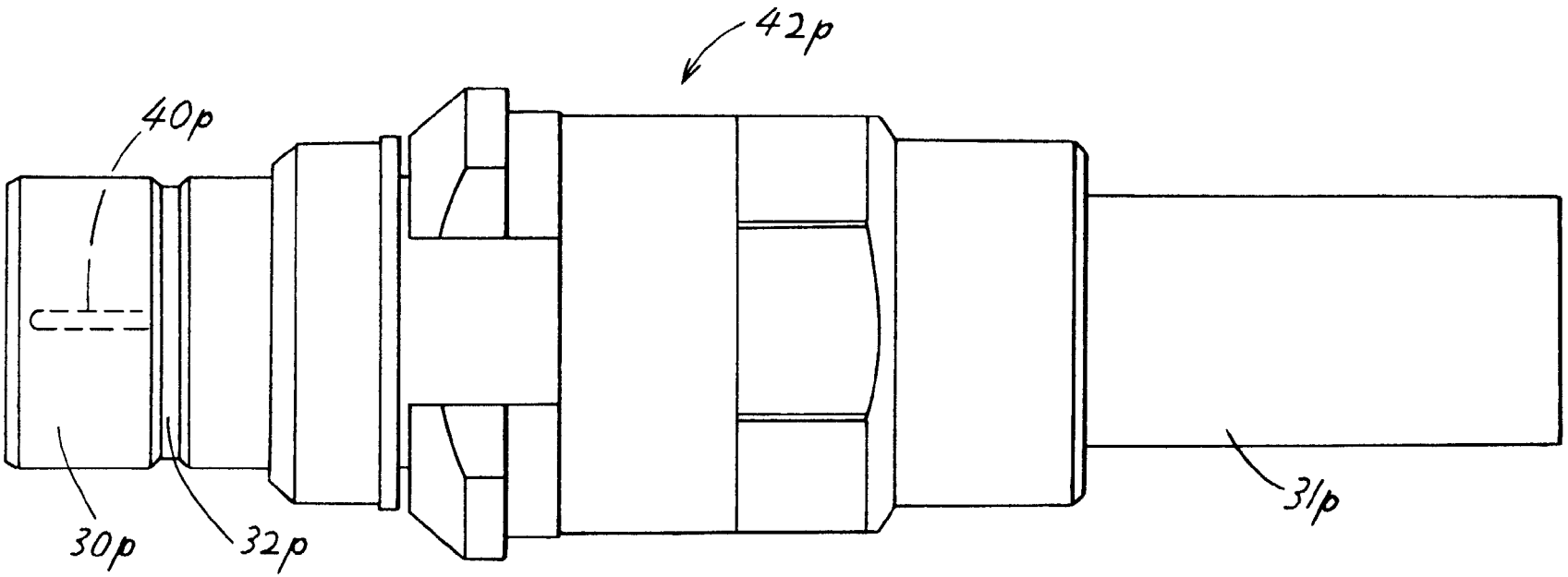
FIG. 2 PRIOR ART

A plurality of tines (4*p*) form a mating means of the connector (1*p*). The tines (4*p*) are positioned such that they form a cavity of the same shape as the other mating half, but the diameter of the cavity is slightly smaller than that of the other mating half. An example of a mating half is shown in FIG. 2. The mating half has a mating end (30*p*) and a cable end (31*p*). The mating half has an external radial groove (32*p*) for receiving an inwardly projecting portion of protuberances (11*p*) of the tines (4*p*). When the two connector halves are mated together, the tines (4*p*) are forced outwards due to the insertion of the other mating half. Once the two mating halves are connected together, the tines (4*p*) become situated around the mating end (30*p*) of the mating half allowing the protuberance (11*p*) of the tines (4*p*) to spring into the groove (32*p*). The sleeve (6*p*) has a blocking portion (9*p*) which prevents the expansion of the tines (4*p*) when the sleeve (6*p*) is in its neutral position due to blocking of the protuberance (11*p*), preventing mating or disconnection. Moving the sleeve (6*p*) in to a position towards the cable end (14*p*) or the mating end (13*p*) of the connector (1*p*) along axis Ap allows the mating or disconnection of the two mating halves since the blocking portion (9*p*) is no longer situated adjacent an outwardly projection portion of the protuberance (11*p*) around the tines (4*p*), and no longer preventing their expansion.

Mating and disconnection of the connector (1*p*) is possible when the sleeve (6*p*) is moved against the spring bias either towards the cable end (14*p*) or towards the mating end (13*p*) of the body (1*ap*). Movement of the sleeve (6*p*) in both directions is permitted as it has been found that during connection it is easier to hold the sleeve (6*p*) in position towards the mating end (13*p*) of the connector (1*p*), whilst during disconnection it is easier to hold the sleeve (6*p*) in a position towards the cable end (14*p*).

The present invention seeks to release the part count of the previously mentioned locking mechanisms for connectors and may simplify and/or reduce the cost of their manufacture.

According to the invention there is provided a connector including a contact for connecting to a mating half and a locking element, the locking element having a locked position preventing connection or disconnection of the contact with the mating half and an unlocked position permitting connection or disconnection, wherein transition between the locked and unlocked positions is governed by a spring means formed as an integral part of the locking element, the spring means being unbiased when the locking element is in the locked position.

The locking element may be slotted to form the spring means. A plurality of parallel slots may be provided in the locking element to form the spring means, the slots may be mutually spaced apart along the locking element with their ends overlapping and may be parallel to a mating end of the connector. Alternatively the element may be helically slotted.

The locking element may be formed by a sleeve which may be cylindrical.

The locking element may comprise a body which is resiliently compressible to provide the spring means. The body may be corrugated to permit resilient compression.

In one advantageous refinement of the invention the contact includes a plurality of tines that expand during the connection and disconnection of the mating half and the locking element includes means for preventing the expansion of the tines.

The locking element may have a first unlocked position towards a mating end of the connector and a second unlocked position away from a mating end of the connector, the locked position being between the two unlocked positions.

The connector may be a coaxial connector.

Figure 3:
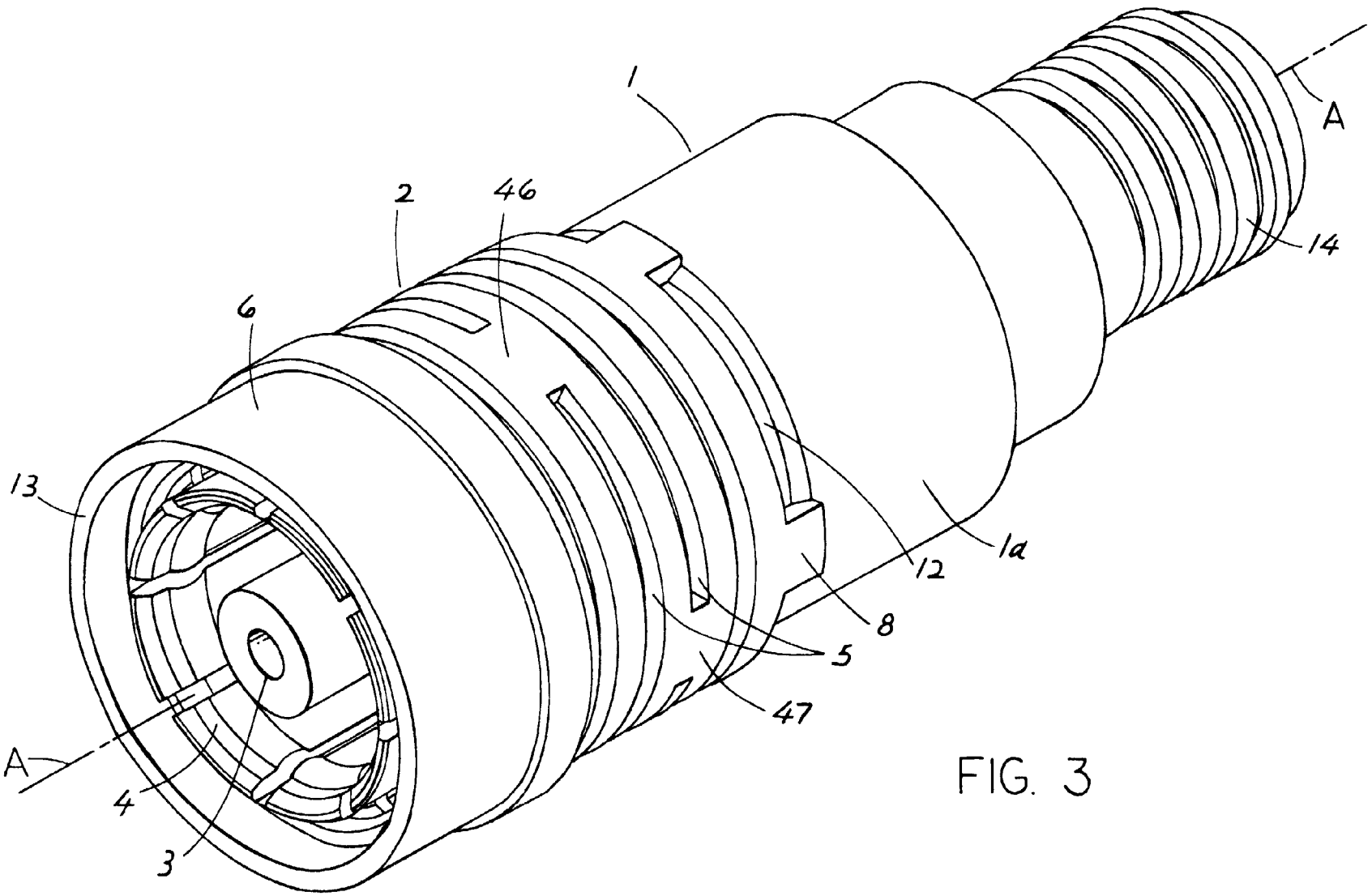
Figure 4:
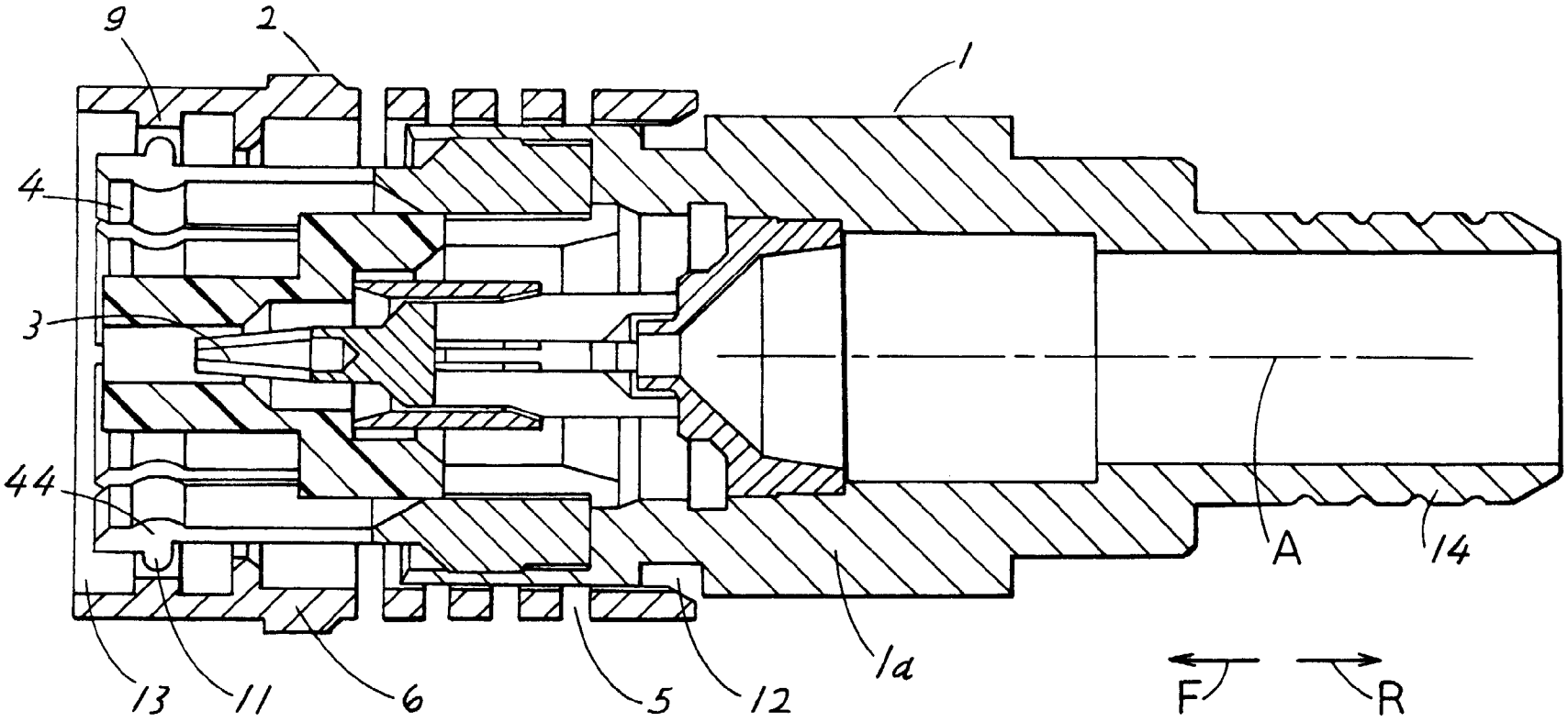
Figure 5:
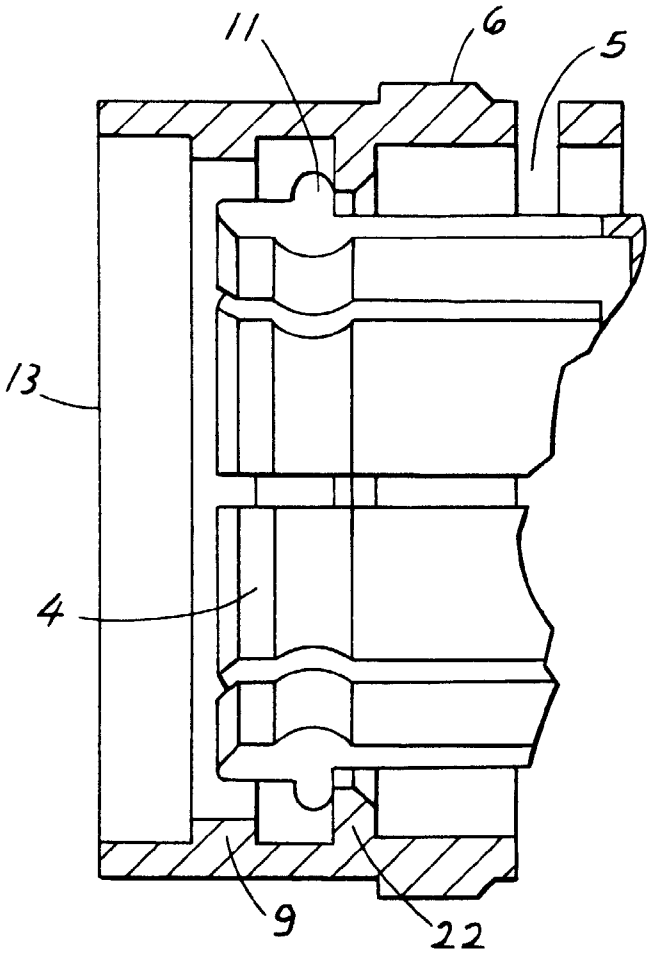
Figure 6:
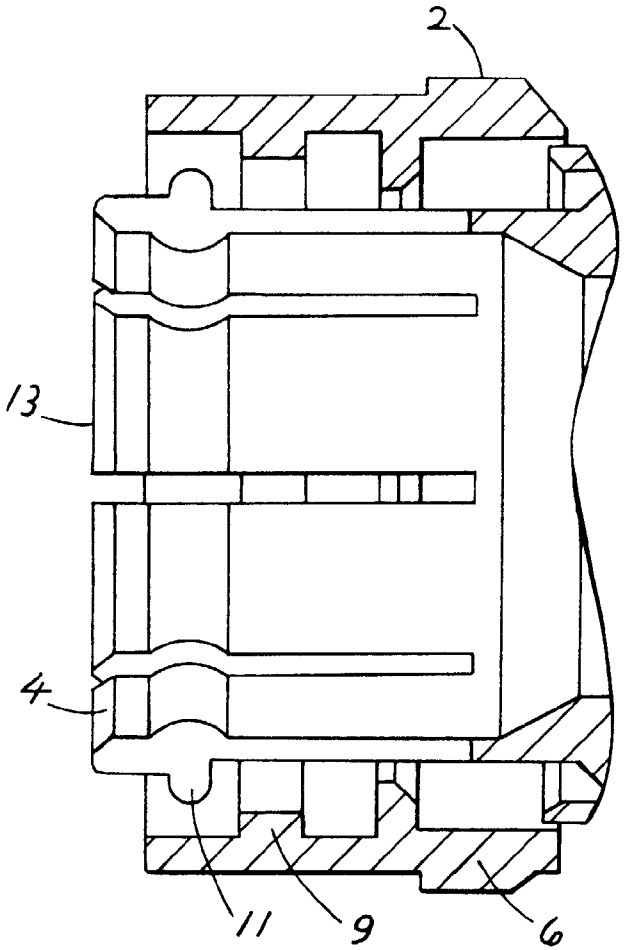

In order that the invention and its various other preferred features may be understood more easily an embodiment thereof will now be described, by way of example only, with reference to the accompanying drawings, in which:

FIG. 1 is an axial cross sectional view of a coaxial connector with a locking mechanism known from the prior art and as previously described, FIG. 2 is a side elevational view of an opposite mating half, FIG. 3 is a perspective view of an embodiment of the present invention, FIG. 4 is a cross sectional view of part of the embodiment of FIG. 3 taken through axis A, where the connector is in its neutral locked position, FIG. 5 is a simplified cross sectional view of part of the embodiment of FIG. 3 taken through axis A where the connector is in an unlocked position with the sleeve in a position towards the mating end of the connector, and FIG. 6 is a simplified cross sectional view of part of the embodiment of FIG. 3 taken through axis A where the connector is an unlocked position with the sleeve in a position towards the cable end of the connector.

Throughout the figures, the same reference numerals are used for similar parts. However, in FIGS. 1 and 2 the parts have a "p" after them to show that they are known in the prior art.

With reference to FIGS. 3 and 4, there is shown a connector (1) with a mating end (13) and a cable end (14), the connector (1) having a locking element (2) in the form of a sleeve (6). The sleeve (6) is located around a female contact (3), the contact (3) being adapted for electrical connection to a male contact (40 in FIG. 2) such as may be incorporated in a mating half, or connector device 42, as shown in FIG. 2. A plurality of tines (4) define an outer contact. The tines have inwardly-projecting (towards the axis A) parts 44 that project into the outside groove 32 of the connector device. The sleeve (6) has a spring means in the form of number of slots (5) extending circumferentially in the connector body. The slots (5) extend most of the way around the sleeve and are disposed such that their ends are in spaced overlapping disposition with one or more adjacent slots so that the sleeve (6) can be extended or compressed along the axis (A). The slots 5 each extends in a non-helical circle of less than 360° to leave slot ends separated by a non-slot part. Adjacent slots have their non-slot parts 46, 47 angled from each other about the axis. When the spring means is neither extended nor compressed, that is unbiased, the locking element is in a locked position. The sleeve (6) is attached to the body of the connector **(1*a*) by a plurality of clips (8) that engage to a groove (12) in the body of the connector (1*a*). The sleeve (6) has a blocking member (9) similar to that of FIGS. 1 and 2 on its internal surface (10)**.

Similarly to FIGS. 1 and 2, the tines (4) have protuberances (11) on their outer surfaces that align with blocking portion (9) of the locking element (2) when the spring means is neither extended nor compressed, that is, it is unbiased. In this situation, the blocking member (9) prevents the tines expanding to allow the insertion of a mating half, hence the locking element is in a locked position.

By extending or compressing the spring means, by sliding the sleeve (6), as is shown in FIGS. 5 and 6 respectively, the blocking portion (9) is moved out of alignment with the protuberances (11) of the tines (4). In this situation, the tines are allowed to expand permitting the insertion of a mating half, hence the locking element is in an unlocked position. As the locking element (2) must be biased into an unlocked position, once the biasing force is released, the spring means forces the locking element (2) to return to the locked position. A shoulder (22) on the internal surface of the sleeve (6) prevents the locking element being over-extended which could possibly damage the spring means. Such an over-extension is prevented since the path of the shoulder (22) is blocked by the protuberances (11) of the tines (4), as is shown in FIG. 5.

Although the invention has been described with reference to coaxial connectors, it could equally be applied to other connectors requiring a locking mechanism. Equally, the invention should not be restricted to cylindrical connectors. For example connectors having a rectangular or polygonal cross section could have a sleeve formed around them and hence could employ the features of the invention. The spring means of the embodiments is formed by a plurality of parallel slots provided in the sleeve. Other forms of spring means within the intended scope of the present invention could include helical slots or slots inclined relative to a radial plane through the connector. Alternatively the body of the sleeve could itself be resiliently compressible by being corrugated or formed from a resiliently flexible material such as rubber.

What is claimed is:

1. A connector including a contact for connecting to a mating half and a locking element, the locking element having a locked position permitting connection or disconnection of the contact with the mating half and an unlocked position preventing connection or disconnection, where transition between the locked and unlocked positions is governed by a spring means formed as an integral part of the locking element, the spring means being unbiased when the locking element is in the locked position;

said spring means comprises a sleeve having an axis and having a plurality of parallel non-helical circular slots that each extends less than 360° about said axis, with said slots being spaced apart along said axis.

2. A connector which has a contact, for receiving a connector device that has a device mating end with an outside groove and that has a contact device that mates with said contact, comprising:

a body having an axis extending in forward and rearward directions and having a forwardly-opening front end for receiving said device mating end, said body having a plurality of tines that surround said device mating end and that have inward-projecting tine parts tht project into said outside groove to hold said body to said device mating end, with said tine having radially outwardly-projecting protuberances;

a sleeve having a rear end that is fixed against axial movement to said body and a front end that forms a blocking part that lies around said tine protuberances in a locked position of said blocking part, said sleeve having a resilient sleeve middle that connects said sleeve front and rear ends, said blocking part being free to move axially forward and rearward from said locked position even when said connector and connector device are mated with said inwardly projecting tine parts lying in said outside groove;

said sleeve middle has a plurality of axially spaced slots that each extends in a non-helical circle of less than 360° about said axis to form slot ends separated by a non-slot part, to make said sleeve middle resilient in both axial compression and expansion;

said sleeve is biased to retain said blocking part in said blocking position, and said blocking part is short enough in an axial direction that said blocking part moves away from said blocking position to allow said tines to move apart when said blocking part is pushed axially forward or rearward during mating and unmating of said connector and connector device.

* * * * *